US006691427B1

(12) United States Patent
Fernandes et al.

(10) Patent No.: US 6,691,427 B1
(45) Date of Patent: Feb. 17, 2004

(54) CONCRETE WALL HEATING AND DRYING SYSTEM

(76) Inventors: John P. Fernandes, 42 Cutler Bay, Winnipeg, Manitoba (CA), R2R 2M9; David M. Swan, Apt# 305-1067 Henderson Highway, Winnipeg, Manitoba (CA), R2K 2M2

( * ) Notice: Subject to any disclaimer, the term of this patent is extended or adjusted under 35 U.S.C. 154(b) by 0 days.

(21) Appl. No.: 10/345,250

(22) Filed: Jan. 16, 2003

(51) Int. Cl.[7] ..... F26B 19/00

(52) U.S. Cl. ..... 34/60; 34/103; 34/104; 34/437; 34/443; 454/186

(58) Field of Search ..... 34/60, 103, 104, 34/443, 439, 235, 437; 454/185, 186, 251, 253, 341, 354; 52/169.5, 302.3

(56) References Cited

U.S. PATENT DOCUMENTS 3,805,405 A * 4/1974 Ambos ..... 34/104
5,419,059 A * 5/1995 Guasch ..... 34/443
5,590,478 A * 1/1997 Furness ..... 34/437
5,893,216 A * 4/1999 Smith et al. ..... 34/103
6,209,221 B1 * 4/2001 Beulens ..... 34/79
6,550,190 B2 * 4/2003 Ruiz et al. ..... 52/169.5

* cited by examiner

*Primary Examiner*—Jiping Lu
(74) *Attorney, Agent, or Firm*—Siemens Patent Services, LC

(57) ABSTRACT

A low pressure, low air volume system for heating and drying concrete walls in a damp environment is disclosed. A wall unit consisting of a wall panel having a plurality of vertical grooves and ridges formed in a back surface, the ridges in contact with a concrete wall surface and the grooves forming a plurality of air channels in contact with the surface of the wall, ducts heated air across the concrete surface of the wall, evaporating moisture migrating through the wall. An upper and lower plenum connect the air channels of the wall unit with a remote system consisting of a dehumidifier and discharge pump, heating element and fans for moving air through the system, the dehumidifier removing the moisture from the air before recirculating it through the system.

8 Claims, 3 Drawing Sheets

CONCRETE WALL HEATING AND DRYING SYSTEM

BACKGROUND OF THE INVENTION

1. Field of the Invention

The present invention relates to heating dehumidifying units. More particularly, the invention comprises a dehumidifying system adapted to concrete walled, subterranean rooms, such as basements.

2. Description of the Prior Art

In order to be suitable for human habitation, a room must be maintained in a relatively warm and dry state. Moisture infiltration through concrete creates discomfort for the inhabitants of a room, and may also cause damage within the room.

U.S. Pat. No. 5,893,216, issued to Terry L. Smith, et al., on Apr. 13, 1999, presents a WALL-DRYING SYSTEM, a portable system wherein air is introduced into a wall cavity through a series of small nozzles attached to a blower and manifold and extracted from the wall cavity through a series of nozzles attached to a second manifold and vacuum. Moisture is extracted from the wall cavity by the airflow therethrough. Unlike the present invention, the drying system of Smith, et al., does not utilize recirculated, heated air to evaporate moisture from the wall cavity.

A METHOD AND APPARATUS FOR CREATING AIR FLOW IN A WALL OR CEILING FOR DRYING PURPOSES THROUGH AN ELECTRICAL BOX is disclosed in U.S. Pat. No. 5,555,643, issued to James A. Guasch on Sep. 17, 1996. Guasch discloses a portable blower having an air supply outlet, a vacuum inlet and a blower outlet to discharge air into the room. A conduit from the air supply outlet is adapted for attachment to a typical wall switch box while the vacuum conduit is adapted for attachment to a typical receptacle box, thereby drawing air through the wall cavity to extract moisture therefrom. Again, unlike the present invention, Guasch provides no recirculated, heated air to aid in withdrawing moisture from the wall cavity.

In U.S. Pat. No. 5,408,759, which was issued to Lenny Bass on Apr. 25, 1995, a WALL DRYING DEVICE is disclosed. A manifold having a plurality of nozzles is attached to a blower, with the nozzles penetrating a wall into the cavity therein. Unlike the present invention, Bass does not provide for re-circulation of heated air to aid in evaporation of moisture from the room.

U.S. Pat. No. 5,155,924, issued to Terry C. Smith on Oct. 20, 1992, discloses a portable, RECONFIGURABLE DRYER SYSTEM FOR WATER-DAMAGED FLOORS AND WALLS. A high volume air blower is connected to a wall and/or floor cavity such that air passes from the blower, through a conduit, into the cavity, and is extracted from the cavity by a second conduit attached to the vacuum side of the blower. The moisture laden air may be discharged by the blower or ducted through a dehumidifier for recirculation through the wall and/or floor cavities.

A HOUSEHOLD DEHUMIDIFIER is disclosed in U.S. Pat. No. 5,092,520, issued to Marc R. Lestage on Mar. 3, 1992. A conduit having an inlet at a lower end, near the floor of a room connects to an outlet in communication with the exterior of the building. A fan within the conduit extracts damp air from the room at the entrance of the conduit, expelling it from the building at the outlet. Unlike the present invention, Lestage does not provide for recirculation of heated air to aid in evaporation of moisture.

Douglas S. Walkinshaw, et al., disclose an ENCLOSURE CONDITIONED HOUSING SYSTEM in U.S. Pat. No. 4,843,786, issued on Jul. 4, 1989. A cavity is formed within the basement wall and floor., into which outside air is drawn and circulated, thereby reducing the accumulation of gasses, such as radon, and moisture in the basement. Again, recirculation and heat are not an element of Walkinshaw's system.

U.S. Pat. No. 4,114,334, issue on Sep. 19, 1978, to Torgay A. Thoren, discloses a BUILDING COMPONENT in which a hollow wall element is constructed with one face being semi-porous and the second face being non-porous. The BUILDING COMPONENT is installed such that the semi-porous face is in contact with a porous lay of a wall, such as a basement wall. The cavity of the BUILDING COMPONENT may be attached to a fan to maintain a reduced pressure in the cavity, thereby encouraging airflow from the porous wall into the cavity. Unlike the present invention, heating and recirculation are absent from Thoren's system.

Johseph H. Thompson discloses a VENTILATING WALL CONSTRUCTION WITH STUD LOCATION INDICATORS, a system for preventing condensation between sheathing and siding in a frame building, in U.S. Pat. No. 3,318,056, issued on May 9, 1967. A sheathing attached to the exterior of the studs of a building has vertical grooves on the outer surface thereof. The ridges between the grooves space the exterior siding from the sheathing, thereby allowing moisture to escape from between the sheathing and siding. Unlike the present invention, Thompson provides no positive airflow or heating of air to aid in evaporation.

In each instance cited hereinabove, the system described is designed to dehumidify wall or floor cavities. By contrast, the present invention is specifically adapted to dehumidify wall surfaces, especially those of concrete walls.

None of the above inventions and patents, taken either singly or in combination, is seen to describe the instant invention as claimed.

SUMMARY OF THE INVENTION

The present invention sets forth a unique heating and drying system for walls in areas, such as residential basements, where high humidity or water seepage may be a problem. By applying polystyrene panels having vertical grooves formed into the back surface, directly to a wall surface, air channels are formed through which dehumidified and heated air may pass, under low pressure to remove moisture from the wall surface. After passing across the wall surface, air is ducted to a remote system consisting of fans, dehumidification and heating elements which process the air for recirculation through the system. By circulating a relatively low volume of air through a closed system, a comfortable environment may be maintained with minimal expenditure of energy.

Accordingly, it is a principal object of the invention is to provide a system for heating and drying concrete walls in a damp or humid environment.

It is another object of the invention to provide a system for heating and drying concrete walls in a damp or humid environment which makes efficient use of energy in accomplishing its intended purpose.

It is a further object of the invention to provide a system for heating and drying concrete walls in a damp or humid environment which is economical to operate.

Still another object of the invention is to provide a system for heating and drying concrete walls in a damp or humid environment which will remove most sources of mold and mildew.

An additional object of the invention is to provide a system for heating and drying concrete walls in a damp or humid environment which will stop moisture from migrating to exterior air and surfaces, such as furniture and carpeting.

It is an object of the invention to provide improved elements and arrangements thereof in an apparatus for the purposes described which is inexpensive, dependable and fully effective in accomplishing its intended purposes.

These and other objects of the present invention will become readily apparent upon further review of the following specification and drawings.

BRIEF DESCRIPTION OF THE DRAWINGS

Various other objects, features, and attendant advantages of the present invention will become more fully appreciated as the same becomes better understood when considered in conjunction with the accompanying drawings, in which like reference characters designate the same or similar parts throughout the several views, and wherein.

DETAILED DESCRIPTION OF THE PREFERRED EMBODIMENTS

Figure 3:
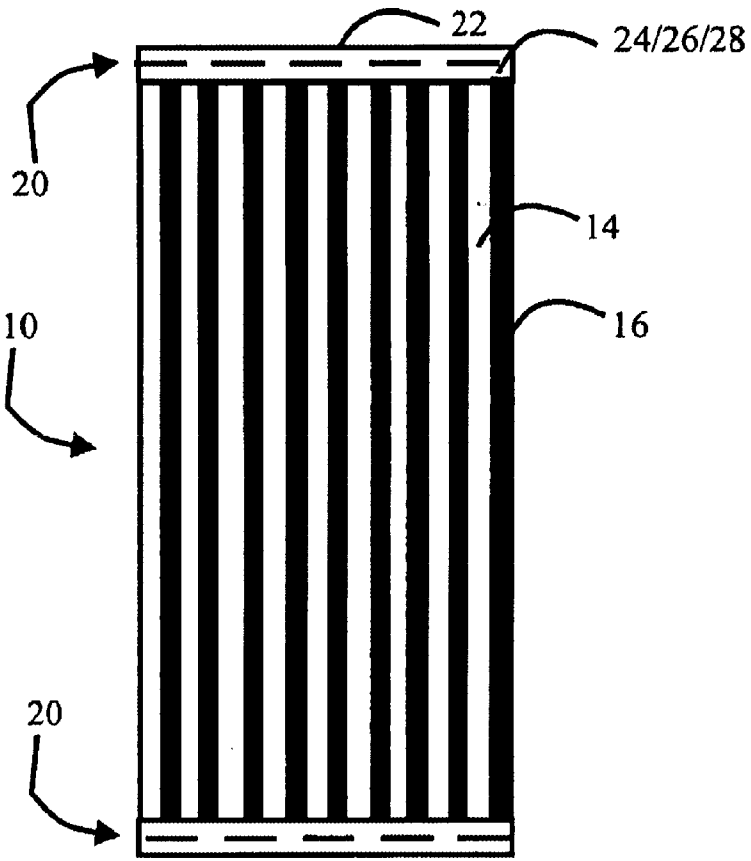
FIG. 3 is a back view of the wall panel and upper and lower plenum of the present invention.
Figure 1:
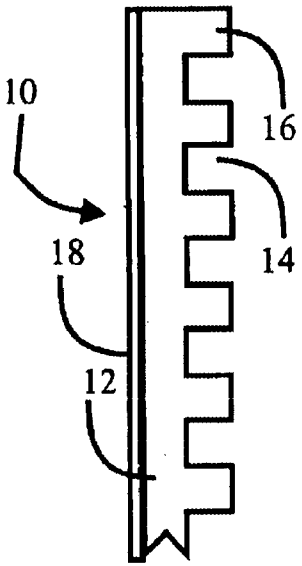
FIG. 1 is a partial cross sectional view of the wall panel of the present invention.

Referring first to FIGS. 1 and 3, the wall panel 10 of the present invention is formed of a material such as, but not necessarily limited to an expanded polystyrene, typically in a standard dimension of 4'×8' or 4'×9', although it would be evident that other dimensions could be used with equal effectiveness. Approximately one half of the thickness of panel 10 is formed as a continuous panel sheathing 12 across the front of panel 10, while a plurality of vertical panel grooves 14, spaced apart by a plurality of vertical panel ridges 16, form the rear portion of panel 10. Each vertical panel grooves 14 is opened at each of the two ends of panel 10. If desired, for aesthetic reasons, wall panel 10 could be faced with variety of different laminate surfaces 18.

Figure 2:
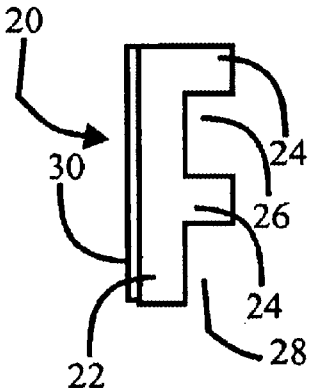
FIG. 2 is a cross sectional view of the upper and lower plenum of the present invention.

FIG. 2 depicts the upper and lower plenums 20, also typically formed of a material such as an expanded polystyrene. Like panel 10, a plenum sheathing 22 forms approximately one half of the thickness of plenum 20, while a plurality of plenum ridges 24 and plenum channels 26, 28 form the rear portion of plenum 20. Typically, a first plenum ridge 24 is adjacent a first length edge of plenum sheathing 22, while a second plenum ridge 24 divides the remainder of plenum 20 into two substantially equal plenum grooves 26, 28, plenum groove 26 being bounded by two plenum ridges 24, and plenum groove 28 being bounded on a first side by the center plenum ridge 24 and open to the second length edge of plenum 20 on a second side, thereby forming a plenum shaped substantially like an upper case letter "F". Like wall panel 10, upper and lower plenums 20 could be faced with a variety of different laminate surfaces 30.

Figure 5:
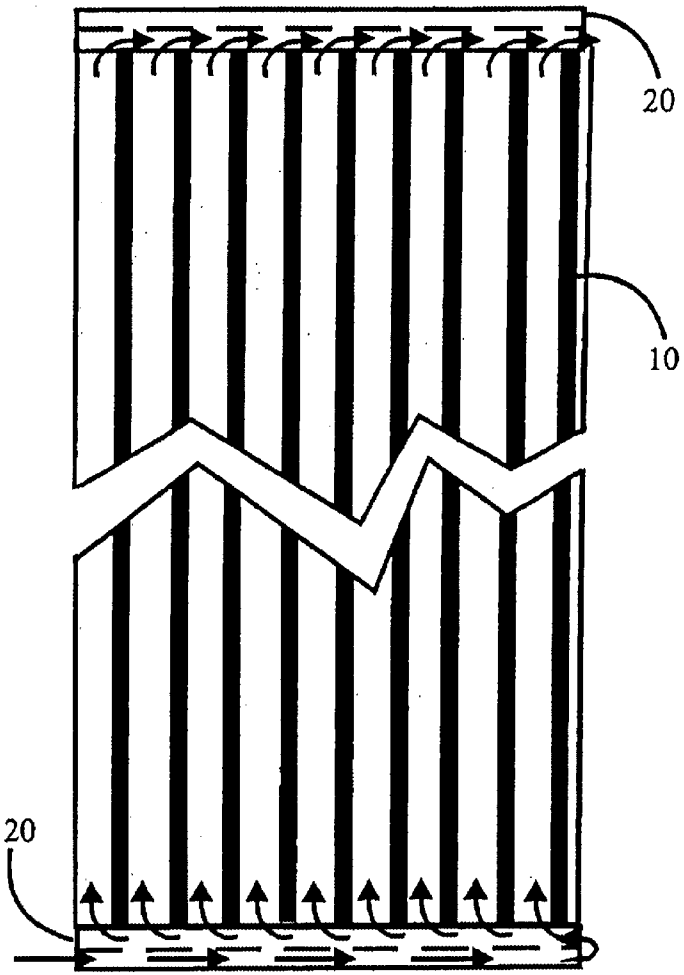
FIG. 5 is a diagrammatic illustration of the air flow within the wall panel and plenums of the present invention.
Figure 4:
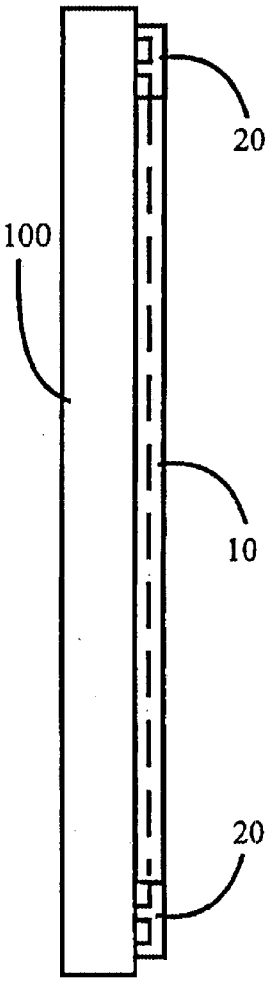
FIG. 4 is a side view of the wall panel and upper and lower plenum of the present invention mounted on a basement wall.

At FIG. 4, wall panel 10 is applied to a wall 100 such that panel ridges 16 abut wall 100, with vertical grooves 14 forming vertical air channels, open at both the top and bottom of wall panel 10. An upper plenum 20 and lower plenum 20 are applied to wall 100 such that plenum groove 28 forms a substantially horizontal air channel along the top and bottom of wall panel 10, with the air channels formed by panel grooves 14 opening into an air channel formed by the abutment of plenum groove 28 and the top or bottom of wall panel 10. Thus installed, a continuous air passage is formed, as illustrated at FIG. 5, from an entrance point of lower plenum 20 at plenum groove 26, along the length of plenum groove 26, returning along plenum groove 24, passing to the plurality of panel grooves 14, then upwardly to plenum groove 28 of upper plenum 20, finally exiting from one end of plenum groove 28.

Figure 6:
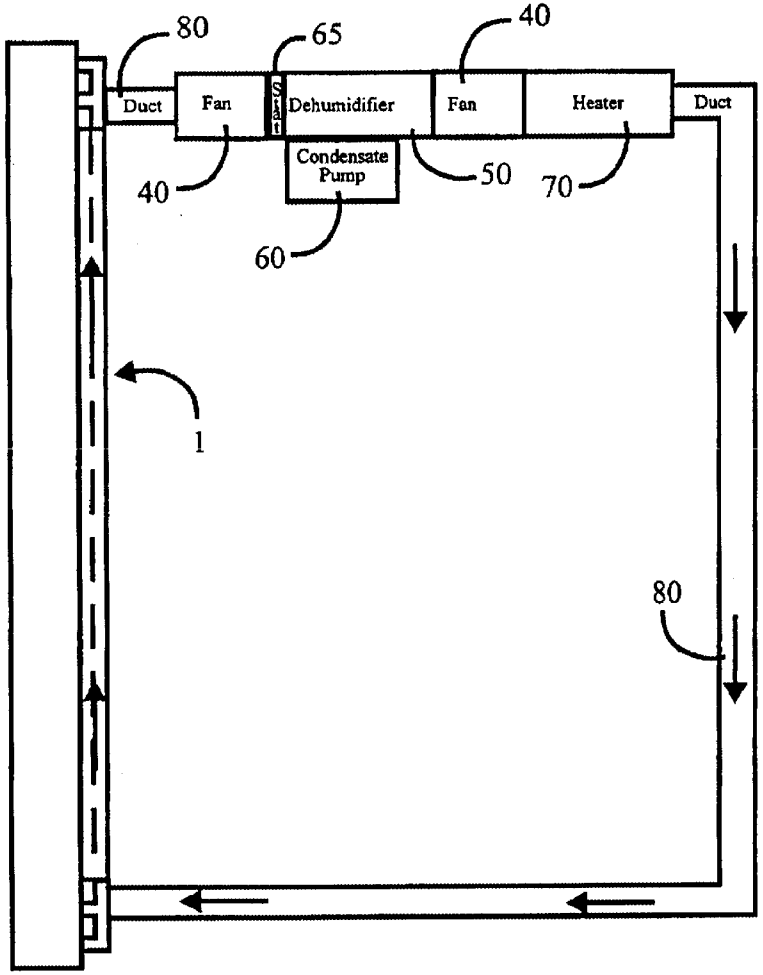
FIG. 6 is a diagrammatic view of the full system of the present invention.

Now turning to FIG. 6, the inventive heating/drying system further consists of remote elements consisting of at least one fan unit 40, a dehumidifying unit 50 with condensate pump 60, and a heating unit 70. As each of these elements is readily known in the art, they will not be discussed in detail, but rather, only in function. In a closed loop, a first fan unit 40 pulls air from upper plenum 20, through a duct 80, conveying it through the coils of dehumidifying unit 50 where moisture is extracted and passed through a condensate pump 60 for discharge from the system. A compressor unit, an integral element of the dehumidifying unit 40 chills the refrigerant passing through the coils of dehumidifying unit 50. After passing through dehumidifying unit 50, the air passes through a second fan unit 40 which forces it through a heating unit 70 where it is warmed before passing through duct 80 to lower plenum 20 and back through wall system 1, the warm air passing through wall system 1 absorbing moisture from wall 100. A humidistat 65 may, optionally, be installed in the remote system to selectively control fans 40, dehumidifying unit 50 and heating unit 70.

It would be evident to one skilled in the art that the heat of heating unit 70 could be derived from any heating source as are commonly known in the art, including, but not limited to, electricity, oil, gas, and solar energy.

It is to be understood that the present invention is not limited to the embodiments described above, but encompasses any and all embodiments within the scope of the following claims.

What is claimed is:

1. A heating and drying system for heating and drying walls in a damp environment comprising:

a wall system, said wall system further comprising:
- sheathing means for sheathing a wall surface, and
- air channeling means for channeling air along said wall surface;

said wall system adapted to be attached to a wall surface; and a remote system, said remote system further comprising:
- ducting means for ducting air between said wall system and said remote system,
- blower means for forcing air through said system heating and drying system,
- dehumidifying means for removing moisture from air within said heating and drying system and expelling said moisture from said system, and
- heating means for heating air within said heating and drying system, said heating and drying system being a closed system.

2. A heating and drying system for heating and drying walls in a damp environment, as defined in claim 1, wherein said wall system further comprises:

a wall panel, said wall panel further comprising:
a front, panel sheathing,
a plurality of panel ridges, and
a plurality of panel grooves; and an upper and a lower plenum, each of said upper and lower plenum further comprising:
a front, plenum sheathing,
at least one plenum ridge, and
at least one plenum groove;

said plurality of panel grooves and said at least one plenum groove of said upper plenum and said lower plenum being adapted to form an air channel to conduct air through said wall system and across said wall surface.

3. A heating and drying system for heating and drying walls in a damp environment, as defined in claim 2, wherein said wall panel and said upper and lower plenum are formed of expanded polystyrene.

4. A heating and drying system for heating and drying walls in a damp environment, as defined in claim 3, wherein said front, panel sheathing and said front plenum sheathing further comprises a laminate facing layer.

5. A heating and drying system for heating and drying walls in a damp environment, as defined in claim 4, wherein said blower means comprises at least one fan unit adapted to move air through said heating and drying system.

6. A heating and drying system for heating and drying walls in a damp environment, as defined in claim 5, wherein said dehumidifying means comprises:

a dehumidification unit having refrigeration coils therein, said dehumidification unit adapted to remove moisture from air withing said system, a compressor, said compressor adapted to chill refrigerant circulating within said refrigeration coils, and a pump, said pump adapted to periodically discharge moisture removed from said air within said system by said dehumidification unit from said system.

7. A heating and drying system for heating and drying walls in a damp environment, as defined in claim 6, wherein said heating means comprises a heating unit.

8. A heating and drying system for heating and drying walls in a damp environment, as defined in claim 7, wherein the heat of said heating unit is provided by at least one source from the group comprising: electricity, oil, gas, and solar energy.

* * * * *